United States Patent [19]

Ludszeweit et al.

[11] 4,245,795

[45] Jan. 20, 1981

[54] SUPPLYING BOBBINS TO WEB SPLICING DEVICES

[75] Inventors: Dieter Ludszeweit; Karl-Heinz Schlüter, both of Hamburg, Fed. Rep. of Germany

[73] Assignee: Hauni-Werke Körber & Co. Kg., Hamburg, Fed. Rep. of Germany

[21] Appl. No.: 96,418

[22] Filed: Nov. 21, 1979

[30] Foreign Application Priority Data

Nov. 28, 1978 [LU] Luxembourg ..... 80589

[51] Int. Cl.[3] ..... B65H 19/20

[52] U.S. Cl. ..... 242/56 R; 242/56 A; 242/58.3

[58] Field of Search ..... 242/56 R, 56 A, 58.1, 242/58.2, 58.3, 58.6; 156/157

[56] References Cited

U.S. PATENT DOCUMENTS

| | | | |
|---|---|---|---|
| 3,640,480 | 2/1972 | Schleich | 242/56 A |
| 3,730,811 | 5/1973 | Wendt | 242/58.3 |

*Primary Examiner*—Edward J. McCarthy
*Attorney, Agent, or Firm*—Peter K. Kontler

[57] ABSTRACT

The device which splices the leaders of webs on successive fresh bobbins to the running webs of expiring bobbins in a cigarette maker receives fresh bobbins from a magazine which discharges fresh bobbins one after the other when the need arises. The discharged fresh bobbin rolls along a downwardly sloping ramp and is arrested by the holder for a blade which is thereupon caused to move in parallelism with the axis of the arrested fresh bobbin so as to sever the outermost layer or layers of convoluted flexible material on the core of such fresh bobbin. The outermost layer is a protective strip which surrounds the outermost convolution of the cigarette paper web. A foraminous belt conveyor is installed below the fresh bobbin which abuts against the holder for the blade and this conveyor cooperates with one or more suction chambers to attract the severed layer or layers as well as the freshly formed leader of the cigarette paper web. The freshly formed leader is transported into the splicing device so that it can be attached to the running web as soon as the supply of cigarette paper on the expiring bobbin is almost exhausted. The fresh bobbin which abuts against the holder for the blade is attached to the spindle of one of several bobbin holders which are indexible with a disk-shaped carrier.

11 Claims, 1 Drawing Figure

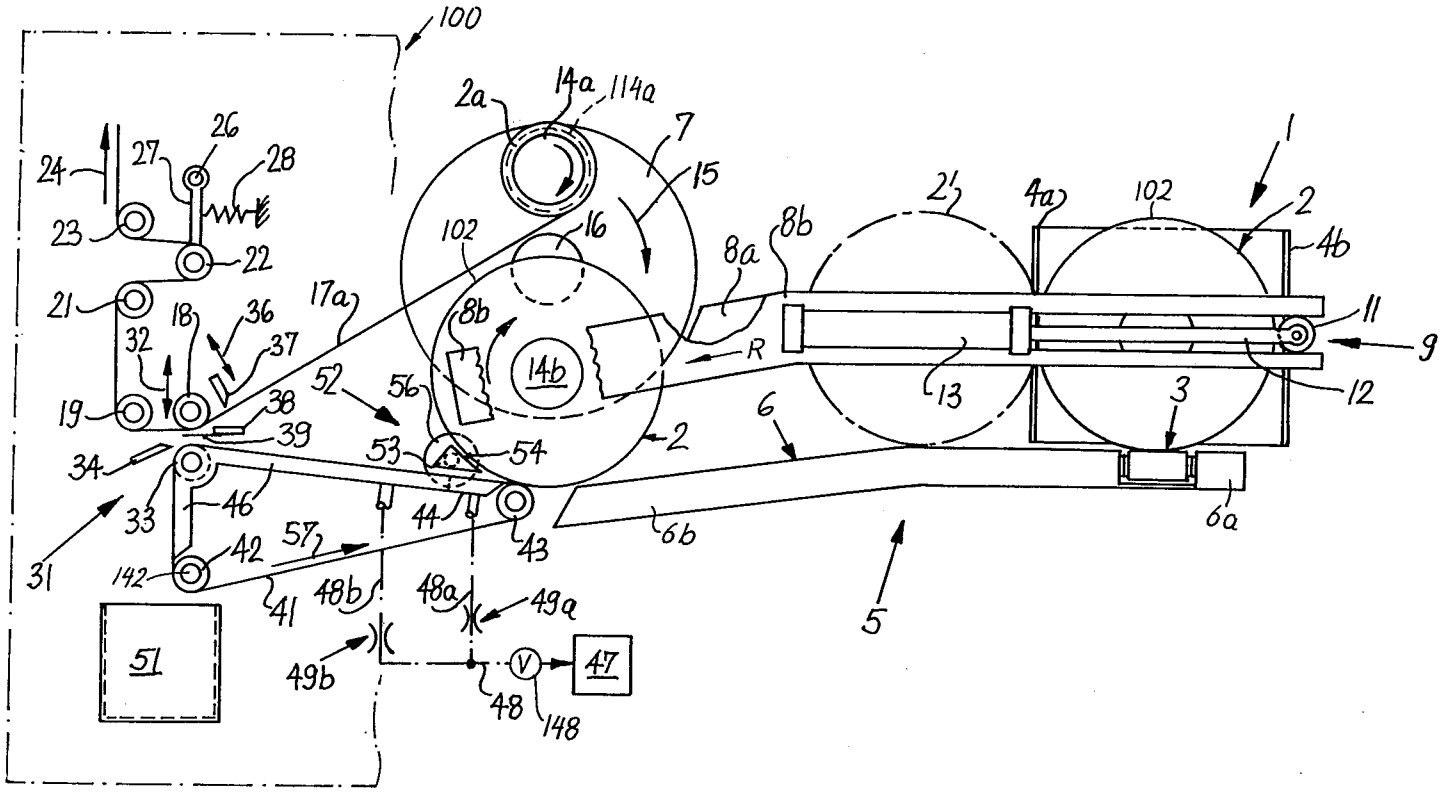
100
1
2
2a
2b
3
4a
4b
5
6
6a
6b
7
8a
8b
9
11
12
13
14a
14b
15
16
17a
18
19
21
22
23
24
26
27
28
31
32
33
34
36
37
38
39
41
42
43
44
46
47
48
48a
48b
49a
49b
51
52
53
54
56
57
102
114a
142
148
R

SUPPLYING BOBBINS TO WEB SPLICING DEVICES

BACKGROUND OF THE INVENTION

The present invention relates to apparatus for manipulating bobbins or reels consisting of or including convoluted tape, web, strip or similar material. More particularly, the invention relates to improvements in apparatus for supplying fresh bobbins to a splicing station where the leader of the web which is stored on the core of the fresh bobbin is to be attached to a running web which is supplied by an expiring bobbin. Apparatus of such character can be used in many types of tobacco processing machines, e.g., in cigarette makers to supply fresh bobbins or reels of convoluted cigarette paper to the station where the leader of a web of cigarette paper on the core of a fresh bobbin can be attached to the web which is supplied by an expiring bobbin. Also, apparatus of such character can be used to supply convoluted web, tape or strip stock to a slicing station in a filter tipping machine wherein cigarette paper, artificial cork or other suitable strip-shaped material is used to make uniting bands serving to connect filter mouthpieces or filter plugs with sections of a tobacco container rod to form therewith filter cigarettes, cigars or cigarillos of unit length or multiple unit length. Furthermore, apparatus of the type to which the present invention pertains can be used with advantage in machines for the production of filter rod sections wherein a tow of filamentary filter material or another rod-like filler or filter material is draped into a web of paper or the like to form therewith a continuous rod which is thereupon severed to yield filter rod sections of desired length.

It is already known to utilize a carrier for two bobbins, namely, an expiring bobbin which feeds web-, strip- or tape-like material to the consuming station of a tobacco processing or like machine and a fresh bobbin which is held in a position of readiness so that its leader can be spliced to the running web as soon as the quantity of convoluted material on the expiring web is reduced to a preselected minimum value. It is also known to store several fresh bobbins in a magazine (e.g., to store a supply which suffices to satisfy the requirements of a cigarette maker during an entire shift or during an entire day if the machine is operated in two or more shifts). Means is provided for transferring fresh bobbins from the magazine to a splicing station where the leader of the web on the fresh bobbin is ready to be spliced to the running web as soon as the need arises. As a rule, the diameter of convoluted material on the expiring bobbin is monitored by a suitable detector which transmits a signal to initiate a splicing operation as soon as the diameter is reduced to a preselected value. Such apparatus further comprise means for advancing the leader of a fresh bobbin (which is held in a predetermined position of readiness) to an optimum position for attachment to the running web.

It is well known that the output of cigarette making and like machines is on the increase. Only a few years ago, a cigarette maker was capable of turning out approximately 4,000 cigarettes per minute. Recent types of cigarette makers produce at least 5,000 and some of them turn out in excess of 6,000 cigarettes per minute. This means that the bobbins must be replaced at frequent intervals in order to avoid a stoppage of such machines for the sole purpose of replacing an expired bobbin with a fresh bobbin which contains a full supply of convoluted wrapping or draping material, such as cigarette paper. Furthermore, the splicing operation must be completed within a very short interval of time, especially if the nature of the splicing device is such that its operation necessitates a temporary slowdown or even temporary stoppage of the web transporting mechanism.

The outermost layer of convoluted web on a fresh bobbin which stores a supply of cigarette paper or the like is normally surrounded by a protective strip or tape which must be removed before the leader of the web on such fresh bobbin is ready for transport to the splicing station. Removal of the protective strip is carried out by hand, i.e., the attendants in a tobacco processing plant or in a plant for the production of filter plugs must sever or break the protective strip and thereupon remove the strip before the leader of the web of useful material (e.g., cigarette paper) is accessible for transport into the range of the splicing device. Since the attendants must also perform other tasks, it can happen that they are incapable of satisfying the need for webs of cigarette paper or like strip-shaped material when the splicing operations must be performed at frequent intervals. On the other hand, the dimensions of fresh bobbins cannot be increased at will for numerous reasons, for example, because excessive bulk and weight would render such bobbins hard to manipulate by the employees who are in charge of a cigarette maker, a filter tipping machine or filter rod making machine.

Commonly owned German Offenlegungsschrift No. 1,532,203 discloses an apparatus which is capable of automatically preparing successive fresh bobbins for splicing of their webs to the running webs of expiring bobbins. The arrangement is such that each fresh bobbin which is inserted into the magazine must be treated or prepared, either in the magazine or prior to insertion into the magazine. From there on, the progress of fresh bobbins to an optimum position with reference to the splicing station is automatic or practically automatic. The treatment which must be carried out (normally before a fresh bobbin is inserted into the magazine) includes severing or breaking the protective strip, removal of the severed or broken protective strip, and attachment of a suitable motion receiving part to the leader of the thus exposed web on the fresh bobbin. The motion receiving part which is attached to the leader of the web on a fresh bobbin which has been relieved of the protective strip is engaged by an entraining element to advance the leader to an optimum position with reference to the splicing device, i.e., to such position that the leader can be attached to the running web as soon as the need to carry out a splicing operation arises. This is time-consuming and is likely to require practically uninterrupted attention on the part of at least one attendant, especially if the attendant is to supervise the operation of several cigarette makers or like machines. As mentioned above, it is customary that an attendant who is in charge of cigarette makers or the like also performs other duties, e.g., oversee the operation of the distributor which delivers tobacco shreds to the rod forming station, monitor the operation of the inspecting device for finished products and/or others.

OBJECTS AND SUMMARY OF THE INVENTION

An object of the invention is to provide an apparatus whose operation is sufficiently automatic to be of great assistance to attendants of cigarette makers or like machines by insuring automatic delivery of fresh bobbins to the splicing station without requiring any treatment of bobbins prior to insertion into the magazine.

Another object of the invention is to provide the apparatus with novel and improved means for automatically removing protective strips from successive fresh bobbins not later than at the splicing station.

A further object of the invention is to provide an apparatus which can be installed in existing machines for the production of cigarettes or the like and which can be used with particular advantage in or with modern machiens for the massproduction of plain of filter tipped smokers' products and/or filter plugs.

Another object of the invention is to provide the apparatus with novel and improved means for gathering and removing broken or severed protective strips.

A further object of the invention is to provide an apparatus whose magazine can receive fresh bobbins in the form they are furnished by the manufacturers of bobbins.

An ancillary object of the invention is to provide novel and improved means for advancing the leaders of webs on the cores of successive fresh bobbins to an optimum position with reference to the splicing device.

The apparatus which embodies the present invention is used to manipulate bobbins having convoluted webs of cigarette paper or other flexible material. The apparatus comprises a magazine for a supply of fresh bobbins, a plurality of bobbin holders movable seriatim to a bobbin receiving station (such holders can be mounted on a carrier which is indexible through angles of preselected magnitude to move successive holders to the bobbin receiving station), a transfer unit including means (e.g., a downwardly sloping ramp flanked by two guides) for delivering fresh bobbins seriatim from the magazine to the receiving station, a severing device at the receiving station, a fluid-operated motor or other suitable means for moving the severing device relative to the fresh bobbin at the receiving station so that the severing device cuts across at least one outermost layer of flexible material on the fresh bobbin at the receiving station (as a rule, the severing device cuts across the customary protective strip which surrounds the outermost convolution of the web on a fresh bobbin which is furnished by the manufacturer of bobbins; however, the severing device can also cut across one or more outermost convolutions of the web), and means for gathering and removing the severed layer or layers of flexible material from the receiving station.

The gathering means preferably includes conveyor means and means for attracting the severed layer or layers to the conveyor means by suction. For example, the conveyor means may include an endless belt conveyor consisting of fluid-permeable material having an upper stretch or reach which is located immediately below the fresh bobbin at the receiving station, and one or more suction chambers disposed below the upper reach of the belt conveyor to attract the severed layer or layers to the upper side of such upper reach. The upper reach is preferably closely or immediately adjacent to the receiving station, and the severing device preferably comprises a blade as well as holder means for the blade. The holder means is reciprocable in parallelism with the axis of the fresh bobbin at the receiving station at a level immediately above the upper reach of the belt conveyor, and such holder means for the blade may constitute a stop to arrest an oncoming fresh bobbin at the receiving station. This insures that the outermost layer or layers of the fresh bobbin at the receiving station are in an optimum position for severing by the blade when the holder means for the blade is set in motion.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE of the drawing is a schematic elevational view of an apparatus which embodies the invention and which can be used to deliver fresh bobbins to the splicing station of a cigarette making machine.

DESCRIPTION OF THE PREFERRED EMBODIMENTS

The apparatus which is shown in the drawing comprises an elongated magazine 1 which extends at right angles to the plane of the drawing and serves to store a requisite supply of fresh bobbins or reels 2. The magazine 1 comprises a bottom wall including a mobile portion 3 (preferably an endless belt or band conveyor whose upper reach can be moved in a direction toward and away from the observer of the drawing) on which the fresh bobbins 2 rest and which can move the entire row or column of fresh bobbins toward the front end of the magazine. The latter further comprises two parallel side walls **4*a* and 4*b* which confine the fresh bobbins 2 in such a way that the lowermost portion of each fresh bobbin must rest on the movable portion or floor 3** of the bottom wall.

The apparatus further comprises a transfer unit 5 which serves as a means for feeding or advancing successive fresh bobbins 2 from the outlet at the front end of the magazine 1 into the range of a splicing device 31. The transfer unit 5 comprises a track 6 which includes a horizontal portion **6*a* in front of the magazine 1 and a downwardly sloping portion or ramp 6*b* between the horizontal portion 6*a* and a receiving station R where a fresh bobbin 2 is removed from the unit 5 and is indirectly attached to an indexible carrier 7. The transfer unit 5 also comprises two lateral guides 8*a* and 8*b* which are elongated panels located in parallel vertical planes and spaced apart from each other by a distance which at least slightly exceeds the thickness of a fresh bobbin 2. The front guide 8*b* is slotted (as at 9) in front of the magazine 1 so that it can receive an entraining roller 11 which is attached to the free end of a piston rod 12 forming part of a double-acting pneumatic cylinder and piston unit 13. The cylinder of the unit 13 is mounted on the unslotted portion of the guide 8*b*, i.e., to the left of the magazine 1 as viewed in the drawing. The entraining roller 11 extends into the space between the magazine 1 and the guide 8*b*, i.e., the rear portion of this roller extends beyond the rear side of the guide 8*b*. The roller 11** normally occupies the starting or extended position which is shown in the drawing.

The carrier 7 is a relatively large disc or cylinder which is rotatable about the axis of a shaft 16 and supports two bobbin holders or holding devices **14*a*, 14*b***.

The spindle of the holder 14a extends into the core of an expiring bobbin or reel 2a whose web 17a is fed to the wrapping station of the machine 100 (e.g., a cigarette maker which can turn out many thousands, preferably in excess of 5,000 plain cigarettes per minute). The holders 14a and 14b are located diametrically opposite each other, i.e., it is necessary to index the carrier 7 through 180 degrees in order to move the holder 14b (with a fresh bobbin 2 thereon) to that position which, in the drawing, is occupied by the expiring bobbin 2a and its holder 14. The holder 14a is then ready to receive a fresh bobbin 2 at the station R.

Each of the holders 14a, 14b is movable (either entirely or in part) at right angles to the plane of the drawing, i.e., in parallelism with the axis of the shaft 16 and carrier 7 so that the spindles of these holders can be inserted into or withdrawn from the cores of bobbins. The means for moving certain portions of the holders 14a, 14b axially preferably comprises suitable double-acting hydraulic or pneumatic cylinder and piston units. The drawing merely shows (by a broken-line circle) the cylinder 114a of the fluid-operated motor which is used to reciprocate the spindle of the holder 14a. The holders 14a and 14b may be similar to or identical with those which are disclosed in the commonly owned patent application Ser. No. 906,754 filed May 17, 1978 by Schluter, now U.S. Pat. No. 4,149,681. The disclosure of this application is incorporated herein by reference. The main difference between the apparatus which is disclosed in the aforesaid patent application and the apparatus of the present invention is that the attendants servicing the apparatus of the aforesaid application must urge a fresh bobbin against the one or the other holder in order to ensure automatic clamping of the fresh bobbin to its holder. On the other hand, the holders 14a and 14b of the apparatus of the present invention can be automatically advanced into the cores of fresh bobbins and are caused to automatically clamp such bobbins as soon as the inserting step is completed. The guide 8b serves as a back support against which a fresh bobbin 2 at the receiving station R is urged while the aforementioned motor (e.g., the cylinder and piston unit including the cylinder 114a) urges the spindle of the corresponding holder (14a) into the core of a fresh bobbin 2 at the station R where the transfer unit 5 is relieved of a freshly delivered bobbin 2 because such bobbin is attached to and clamped by the holder 14a or 14b.

The shaft 16 can be said to form part of the means for indexing the carrier 7 through angles of 180 degrees so as to place the holder 14a or 14b into register with a fresh bobbin 2 which has been advanced to the station R, i.e., to the end of the path which is defined by the transporting unit 5. The direction in which the shaft 16 indexes the carrier 7 is indicated by the arrow 15.

The running web 17a which is drawn off the expiring bobbin 2a on the holder 14a is advanced in the direction of the arrow 24. This web is trained over rolls 18, 19, 21, 22 and 23. The roll 22 is a dancer roll and is mounted on a lever 27 which is pivotable about the axis of a shaft 26. A spring 28 tends to pivot the lever 27 in a counterclockwise direction, as viewed in the drawing, so as to maintain the web 17a under tension. The lever 27 actuates a potentiometer (not shown) in a manner and for the purpose as disclosed in the commonly owned patent application Ser. No. 856,573 filed Dec. 1, 1977 by Bottcher et al, now U.S. Pat. No. 4,131,501. The purpose of the potentiometer is to transmit signals which are transmitted to bobbin brakes associated with the holder 14a and 14b. The brakes are adjusted in dependency on changes of tensional stress upon the running web. A switchover device (also disclosed in the application Ser. No. 856,573) is utilized to connect the potentiometer with the braking device for that holder which carries the expiring reel. Thus, when the holder 14a carries an expiring reel (2a), the braking device for the reel 2a on the holder 14a is controlled by the potentiometer via switchover device in dependency on changes in the tensional stress upon the running web 17a. The switchover device is actuated by the splicing device 31 or in synchronism with the splicing device so as to ensure that the potentiometer invariably transmits signals to the braking device for the expiring web. The disclosure of the aforesaid application Ser. No. 856,573 is incorporated herein by reference.

The splicing device 31 comprises the aforementioned roll 18 which is movable in directions indicated by a double-headed arrow 32. In addition, the splicing device 31 comprises a roll 33 which is normally spaced apart from the roll 18 and is rotatable about a fixed axis. The running web 17a is transported through the space between the rolls 18 and 33 on its way toward and past the roll 19. Still further, the splicing device 31 comprises a stationary knife 34, a second knife 37 which is movable in directions indicated by a double-headed arrow 36 and a support 38 for an adhesive-coated uniting band 39. This band is adhesive at both sides and is attached to the support 38 in such a way that it can be readily detached therefrom when its sides contact and adhere to the running web 17a as well as to the leader of a fresh web 2. Full details of a splicing device which is similar to the device 31 are disclosed in commonly owned U.S. Pat. No. 3,749,634 granted July 31, 1978 to Krause. The disclosure of this patent is incorporated herein by reference.

The aforementioned roll 33 constitutes one of three pulleys for an endless foraminous belt conveyor 41 which can be driven to move in the direction indicated by arrow 57. The other two pulleys for the conveyor 41 are shown at 42 and 43. The purpose of the upper reach of the conveyor 41 is to advance the leader of the web on a fresh bobbin 2 into the splicing device 31, namely, into the space between the rolls 18 and 33. The upper reach of the conveyor 41 travels above a first suction chamber 44 and above the major portion of a second suction chamber 46. The smaller portion of the suction chamber 46 is adjacent to the downwardly moving left-hand stretch of the conveyor 41. The outer sides of the suction chambers 44 and 46 are open or permeable to air so that these chambers can draw air through the respective stretches of the conveyor 41. The two suction chambers are preferably sealed from each other. A suction generating device 47 (e.g., a blower) is connected with the suction chambers 44 and 46 by two conduits 48a, 48b which merge into a single conduit 48. The latter is connected to the intake of the suction generating device 48. The conduits 48a and 48b, respectively, contain preferably adjustable flow restrictors 49a, 49b which determine the pressure in the suction chambers 44, 46 when the paths for the flow of air from these chambers into the suction generating device 47 are open.

The pulley 42 for the belt conveyor 41 is located above the open top of a collecting receptacle 51 for waste material.

The apparatus further comprises a severing device 52 which is installed in the frame (not shown) of the apparatus at a level immediately above the upper reach of the conveyor 41 and close to the top of the suction chamber 44. The severing device 52 comprises a blade 54 which projects only slightly from its holder means 53. The holder means 53 is movable at right angles to the plane of the drawing, i.e., in parallelism with the axis of a fresh bobbin 2 on the holder 14*a* or 14*b* of the carrier 7, by a motor which preferably includes a pneumatically or hydraulically operated double-acting cyclinder and piston unit 56. When moved to a starting position (close to the observer of the drawing), the blade 54 of the severing device 52 is adjacent to the last portion of the path of movement of successive fresh bobbins 2 along the ramp 6*b*, i.e., the blade is located in front of the station R. In such starting position of the blade 54, the holder means 53 of the severing device 52 can serve as a stop for the oncoming fresh bobbin 2. This insures that the bobbin 2 which rolls along the ramp 6*b* and is arrested by the holder means 53 comes to a halt (at the station R) in a position of accurate register with that holder (14*a* or 14*b*) which does not carry the expiring bobbin. When the cylinder and piston unit 56 thereupon moves the holder 53, the latter is ultimately located behind the fresh bobbin 2 which registers with the holder 14*a* or 14*b* but is not (or need not be), as yet, attached thereto. When the shaft 16 thereupon indexes the carrier 7, the fresh bobbin 2 on the holder 14*a* or 14*b* moves past the holder means 53.

The operation of the structure which is shown in the drawing is as follows:

It is assumed that the parts of the apparatus are held in the illustrated positions and that the advancing mechanism of the machine 100 moves the running web 17*a* in the direction of the arrow 24, e.g., onto the upper reach of a conveyor known as garniture and commonly used in cigarette makers to support a tobacco filler and a web of cigarette maker while the web is draped around the filler to form therewith a continuous cigarette rod which is thereupon severed by a cutoff to yield a succession of discrete plain cigarettes of desired length. The holder 14*a* on the carrier 7 supports the expiring bobbin 2*a*, and the holder 14*b* supports a fresh bobbin 2. The holder means 53 with its blade 54 is located in its starting position (in front of the bobbin 2 on the holder 14*b* at the station R) and is in the process of being moved rearwardly (away from the observer of the drawing) by the piston rod of the double-acting cylinder and piston unit 56. The cutting edge of the blade 54 extends only slightly beyond the holder means 53; however, this suffices to enable the blade 54 to sever the protective strip 102 which surrounds the outermost convolution of the web which is wound onto the core of the fresh bobbin 2 on the holder 14*b* at the station R. In many instances, or even as a rule, the blade 54 also severs one or more outermost convolutions of the cigarette paper web on the fresh bobbin 2 which is supported by the holder 14*b*. Thus, the blade 54 forms at least one tape or layer of finite length (namely, the layer which is obtained by severing the protective strip 102) and preferably two or more tapes or layers of finite length (the other tapes or layers are obtained as a result of severing of one or more outermost convolutions of the web of cigarette paper which is wound onto the core of the bobbin 2 at the receiving station R). Such tapes or layers descend onto the upper reach of the belt conveyor 41 in the region of the suction chamber 44, and the latter insures that the layers adhere to the conveyor 41. The conveyor 41 is thereupon set in motion to advance in the direction of the arrow 57 (for example, the drive means for the conveyor 41 can include the shaft 142 of the pulley 42). Therefore, and because the layers adhere to the upper reach of the conveyor 41, the latter can remove such layers from the bobbin 2 on the holder 14*b* at the station R. Since the layers initially surround the bobbin 2 on the holder 14*b* along a large portion of the circumference of the outermost undamaged or non-severed convolution of the cigarette paper web, frictional engagement between such layers and the convoluted cigarette paper web suffices to set the bobbin 2 on the holder 14*b* in rotary motion (in a clockwise direction, as viewed in the drawing). Furthermore, the conveyor 41 attracts and invariably advances the freshly formed leader of the cigarette paper web on the bobbin which is supported by the holder 14*b* at the station R. The freshly formed leader is that end portion of the convoluted cigarette paper web which is immediately adjacent to one side of the cut in the innermost severed convolution of the web on the bobbin 2 at the receiving station R. The entrainment and advancement of the freshly formed leader of the web on the bobbin 2 which is supported by the holder 14*b* is ensured even if the upper reach of the conveyor 41 begins to slip relative to the aforementioned layers including the layer which is obtained by severing the protective strip 102. The layer which is obtained by severing the protective strip 102 lies directly on the upper reach of the conveyor 41. The latter transports the layers through the space between the rolls 18, 33 (below the path of the running web 17*a* which is trained directly about the roll 18) and causes such layers to descend into the receptacle 51. The fresh leader of the cigarette paper web on the bobbin 2 which is carried by the holder 14*b* at the station R also advances toward and normally into the receptacle 51 because it is attracted to the upper reach of the conveyor 41. The speed of this conveyor increases so that it ultimately matches or at least closely approximates the speed of the running web 17*a*. The speed of the web which is drawn off the fresh bobbin 2 on the holder 14*b* at the station R is monitored and, when such speed matches the speed of the running web 17*a*, the splicing device 31 receives a signal which initiates a movement of the roll 18 toward the roll 33. This, in turn, causes the running web 17*a* to adhere to the upper side and the web which is drawn off the fresh bobbin 2 on the holder 14*b* at the station R to adhere to the underside of the uniting band 39 on the support 38. The band 39 is automatically detached from its support 38 and splices the web coming off the fresh bobbin 2 on the holder 14*b* to the running web 17*a*. At the same time, the knife 37 is set in motion to sever the running web 17*a* behind the freshly formed splice, i.e., the web 17*a* is separated from the expired bobbin 2*a* which is then ready for detachment from the holder 14*a*. That portion of the leader of the web coming off the fresh bobbin 2 on the holder 14*b* at the station R which is located ahead of the splice (i.e., ahead of the uniting band 39 subsequent to detachment of this band from the support 38) is automatically separated from the fresh bobbin 2 on the holder 14*b* by the stationary knife 34 as a result of further movement of the uniting band 39 in the direction of the arrow 24 (i.e., along a path for transport of running webs to the corresponding station of the consuming machine 100). At the same time, the chambers 44 and 46 are sealed from the suction generating device 47 (e.g., by a valve 148 in the conduit 48) so that the web which is drawn off the fresh bobbin 2 on the holder 14*b* ceases to adhere to the upper reach of the conveyor 41. The conveyor 41 can be arrested by interrupting the transmission of torque to its pulley 42.

The shaft 16 can index the carrier 7 immediately after the splicing operation is completed, i.e., as soon as the web which is drawn off the fresh bobbin 2 on the holder 14*b* at the receiving station R begins to advance to the corresponding station of the machine 100. Alternatively, such indexing (to interchange the positions of the holders 14*a* and 14*b* in response to clockwise rotation of the carrier 7 through 180 degrees) can take place when the outer diameter of the bobbin 2 on the holder 14*b* is reduced to a predetermined value. The remnant (including the core) of the expired bobbin 2*a* is detached from the carrier 7 in response to retraction of the spindle forming part of the holder 14*a* (such retraction is effected by the fluid-operated motor 114*a*) whereby the remnant of the bobbin 2*a* drops into a suitable box or the like, not specifically shown, or onto a conveyor which removes the expired bobbin from the machine 100.

In the next step, the mobile bottom or floor portion 3 of the magazine 1 is advanced by a step so that the upper reach of the endless conveyor constituting or forming part of the portion 3 moves toward the observer of the drawing. This advances the foremost fresh bobbin 2 in the magazine 1 toward and against the front guide 8*b*. The portion 3 is thereupon moved backwards through a small distance so as to ensure that the foremost fresh bobbin 2 is disengaged from the inner or rear side of the guide 8*b* but is still located in the path of leftward movement of the entraining roller 11. The motor 13 is then actuated to retract the piston rod 12 into the cylinder of the motor 13 whereby the roller 11 entrains the foremost bobbin 2 from the floor portion 3 onto the horizontal portion 6*a* and thereupon onto the downwardly sloping portion or ramp 6*b* of the track 6. The foremost bobbin 2 begins to roll along the ramp 6*b* when it reaches the phantom-line position 2'. In the meantime, the motor 56 has returned the holder means 53 and the blade 54 to the aforementioned starting position in which the holder means 53 extends across the path of and constitutes a stop for the foremost bobbin 2 which rolls along the ramp 6*b*. The motor 114*a* is then actuated to introduce the spindle of the holder 14*a* into the core of the bobbin 2 which abuts against the holder means 53. As mentioned above, the holder 14*a* automatically clamps and thus retains the fresh bobbin 2 as soon as its spindle completes its movement into the central opening of the core forming part of the fresh bobbin at the station R. For example, the clamping means of the holder 14*a* can be responsive to a predetermined pressure which develops when the bobbin 2 on the holder 14*a* is biased against the guide 8*b* with a predetermined force. Other suitable means for initiating the clamping action can be used with equal advantage. For example, a photocell can be used to generate a signal when the spindle of the holder 14*a* has been advanced through a predetermined distance in a direction to enter the core of the fresh bobbin 2 at the lower end of the ramp 6*b*, i.e., at the station R.

The apparatus has completed a full cycle when a fresh bobbin 2 is properly attached and clamped to the holder 14*a* at the station R. The next splicing operation is started when the supply of convoluted web on the bobbin which is supported by the holder 14*b* (such holder is then held in the position shown in the drawing as being occupied by the holder 14*a*) is reduced to a predetermined minimum value.

An important advantage of the improved apparatus is that the magazine 1 can receive fresh bobbins 2 in the form in which they are furnished by the manufacturer of bobbins. Thus, the attendants need not prepare the bobbins 2 for insertion into the magazine 1 by removing the protective strips 102 and/or by performing other operations, such as the attachment of motion receiving devices to the leaders of webs on the fresh bobbins. This simplifies the task of attendants and enables them to devote their attention to other units of the machine 100 or of the production line wherein the machine 100 constitutes but one of several cooperating machines.

The exact nature of the control system which includes the aforediscussed monitoring means for the diameters of bobbins and which causes the mobile parts (including the roll 18, the knife 37 and the conveyors 3 and 41) to perform certain movements in a given sequence and at a selected speed forms no part of the present invention.

The aforementioned positioning of the gathering means (including the conveyor 41 and the suction chambers 44, 46) and of the severing device 52 contributes to compactness of the improved apparatus. Moreover, such mounting of these parts ensures that the layers which are formed by the blade 54 when the motor 56 moves the holder means 53 in parallelism with the axis of the bobbin 2 at the station R invariably descend by gravity onto and are advanced by the upper reach of the conveyor 41. The suction chambers 44, 46 contribute to reliability of the gathering means for the just discussed layers including the severed protection strip 102.

It has been found that the improved apparatus not only occupies less room than conventional apparatus but is capable of ensuring a fully automatic delivery of successive fresh bobbins 2 to the receiving station R, i.e., into the range of the splicing device 31.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

We claim:

1. In an apparatus for manipulating bobbins having convoluted webs of cigarette paper or other flexible material, the combination of a magazine for a supply of fresh bobbins; a plurality of holders movable seriatim to a bobbin receiving station; a transfer unit including means for delivering fresh bobbins seriatim from said magazine to said station; a severing device at said station; means for moving said severing device relative to the fresh bobbin at said station so that said device severs at least one outermost layer of flexible material on such bobbin; and means for gathering and removing the severed layer or layers of flexible material from said station.

2. The combination of claim 1, wherein each fresh bobbin includes a protective strip which constitutes the outermost layer of flexible material on the respective bobbin and said severing device includes means for cutting across such protective strip of the fresh bobbin at said station.

3. The combination of claim 1, wherein said gathering means comprises conveyor means and means for attracting the severed layer or layers to said conveyor means by suction.

4. The combination of claim 3, wherein said conveyor means is closely adjacent to said station.

5. The combination of claim 1, wherein said severing device comprises a blade and reciprocable holder means for said blade.

6. The combination of claim 5, wherein said moving means includes means for reciprocating said holder means for said blade in substantial parallelism with the axis of the fresh bobbin at said station.

7. The combination of claim 1, wherein said gathering means comprises an endless fluid-permeable conveyor and at least one suction chamber adjacent to and arranged to draw air through said conveyor so that the latter attracts said several layer or layers of flexible material.

8. The combination of claim 7, wherein said conveyor is a belt conveyor having an upper reach adjacent to the fresh bobbin at said station and said suction chamber is disposed at the underside of said upper reach.

9. The combination of claim 1, wherein said gathering means includes a suction-operated conveyor which is disposed at a level immediately below the fresh bobbin at said station.

10. The combination of claim 9, wherein said severing device is disposed immediately above said conveyor.

11. The combination of claim 1, wherein said severing device includes a portion constituting a stop for a fresh bobbin which arrives at said station.

* * * * *